US007135632B2

(12) United States Patent
Heselton

(10) Patent No.: US 7,135,632 B2
(45) Date of Patent: Nov. 14, 2006

(54) DRUM ACCESSORY FOR IMPARTING FLIPPING MOTION TO A DRUM STICK

(76) Inventor: Todd M. Heselton, 828 Court St., Utica, NY (US) 13502

( * ) Notice: Subject to any disclaimer, the term of this patent is extended or adjusted under 35 U.S.C. 154(b) by 0 days.

(21) Appl. No.: 10/906,198

(22) Filed: Feb. 8, 2005

(65) Prior Publication Data

US 2006/0174752 A1 Aug. 10, 2006

(51) Int. Cl.
*G10D 13/02* (2006.01)

(52) U.S. Cl. ..... 84/421; 84/422.4

(58) Field of Classification Search ..... 84/422.4, 84/421

See application file for complete search history.

(56) References Cited

U.S. PATENT DOCUMENTS 890,161 A 6/1908 Mueller
923,610 A 6/1909 Wanamaker
3,677,127 A 7/1972 Garven
4,028,984 A * 6/1977 Sanchez ..... 84/422.2
4,939,972 A * 7/1990 Falberg ..... 84/422.4
5,551,660 A * 9/1996 Leduchowski ..... 248/276.1

* cited by examiner

*Primary Examiner*—Kimberly Lockett
(74) *Attorney, Agent, or Firm*—George R. McGuire; Bond, Schoeneck & King PLLC

(57) ABSTRACT

The present invention provides a drum accessory that may be connected to a drum and used by a drummer to impart a flipping motion to his/her drum stick. The drum accessory generally comprises a body member that includes an elongated channel formed on its upper surface, an intermediate clamping member, and a base mechanism connected to the body member and the clamping mechanism for interconnecting the accessory to a drum. A spring interconnects the body member to the clamping member and provides the user initiated force that imparts the flipping motion to a drumstick.

17 Claims, 2 Drawing Sheets

DRUM ACCESSORY FOR IMPARTING FLIPPING MOTION TO A DRUM STICK

FIELD OF THE INVENTION

The present invention relates to drum accessories, and more particularly to an accessory used by a drummer to impart a flipping motion to a drum stick.

DESCRIPTION OF THE PRIOR ART

Drummers enjoy providing entertainment to those attending a concert, parade, or other music show. In addition to providing the percussive rhythm of the music being played, drummers may also manipulate the drum sticks in an entertaining manner. For instance, flipping a drum stick into the air and catching it in the midst of playing the instrument is a common drummer's trick. Aside from a drummer holding and flipping a stick in the air, there are no known accessories for assisting a drummer in performing this trick.

OBJECTS AND ADVANTAGES

It is therefore a principal object and advantage of the present invention to provide a drum accessory that assists a drummer in imparting a flipping motion to his/her drum stick.

It is an additional object and advantage of the present to provide a drum accessory that is usable with a variety of drum types.

It is an additional object and advantage of the present invention to provide a drum accessory that includes a pleasing appearance.

Other objects and advantages of the present invention will in part be obvious and in part appear hereinafter.

SUMMARY OF THE INVENTION

In accordance with the foregoing objects and advantages, the present invention provides a drum accessory that may be connected to a drum and used by a drummer to impart a flipping motion to his/her drum stick. The drum accessory generally comprises a body member that includes an elongated channel formed on its upper surface, an intermediate clamping member, and a base mechanism connected to the body member and the clamping mechanism for interconnecting the accessory to a drum. A pivot rod and spring interconnect the base member to the body member and permit the body member to pivot about the pivot rod relative to the base member. When the spring is in its unbiased condition, the body member rests with its bottom surface in contacting relation to the intermediate clamping member. By pressing downwardly on the upper surface of the body member, it pivots about the pivot rod and when released, the spring recoils and forces it back into its resting position relative to the clamping member.

The body member further includes a cavity formed in its leading edge that is adapted to receive the tip of a drum stick therein. The drum stick lies lengthwise in the groove formed in the upper surface of the body member, and its tip extends into the cavity formed at the leading edge, thereby retaining the stick in position absent some external force being applied to the body member. In operation, a user would press downwardly on the free end of the drum stick, thereby causing the body member to pivot away from the intermediate clamping member. When released, the recoiling of the spring causes the body member to rapidly pivot back towards the intermediate clamping member and the drum stick disengages from the body member with its tip contacting the upper portion of the cavity defining enclosure, thereby causing a forward flipping trajectory to be imparted too the stick. The more the body member is depressed by the user, the greater the flipping trajectory that will be imparted to the drum stick. Likewise, the lesser the amount of depression imparted to the body member, the less the drum stick will flip.

BRIEF DESCRIPTION OF THE DRAWINGS

The present invention will be more fully understood and appreciated by reading the following Detailed description in conjunction with the accompanying drawings, in which.

DETAILED DESCRIPTION

Figure 1:
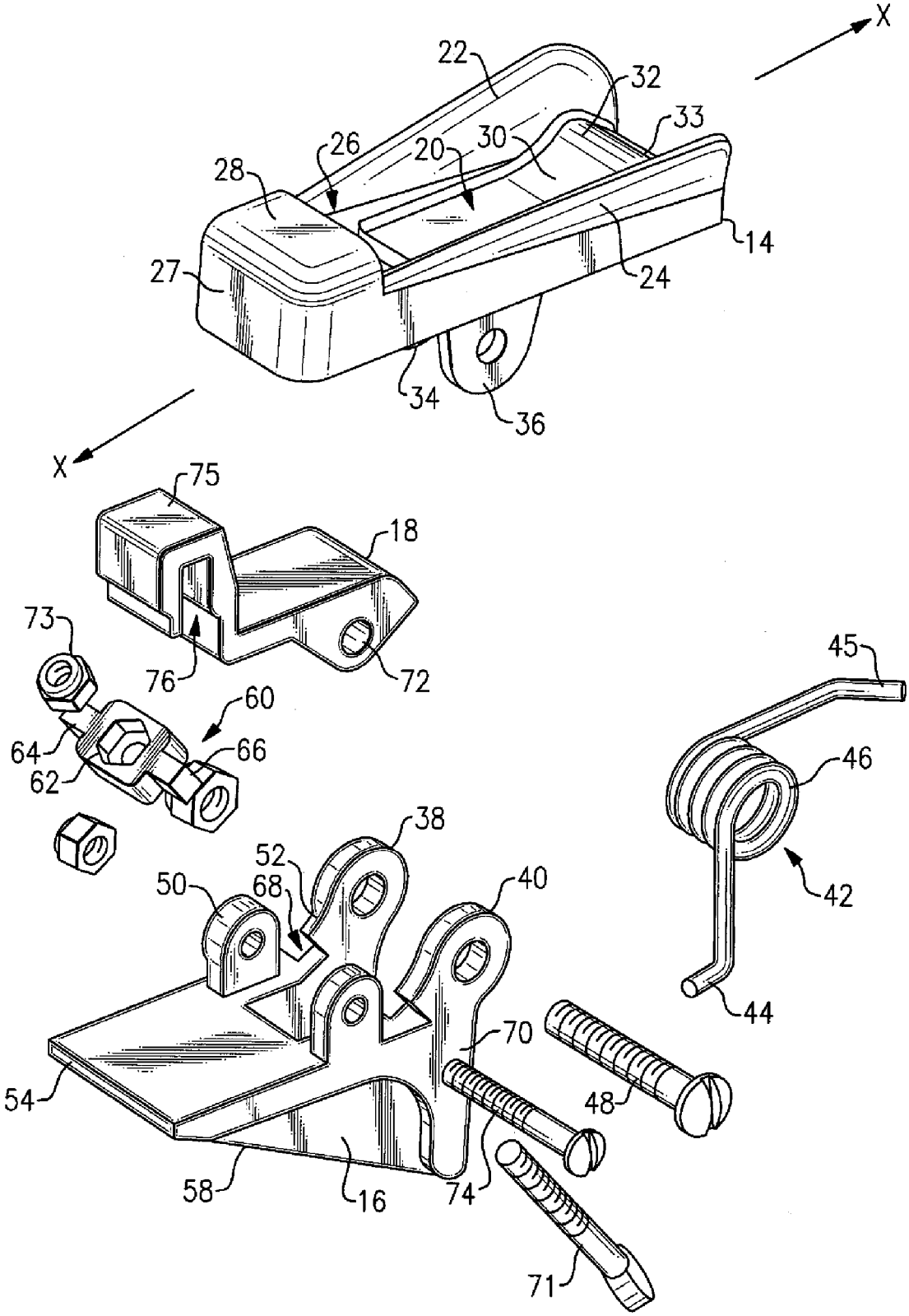
FIG. 1 is an exploded perspective view of the present invention.
Figure 4:
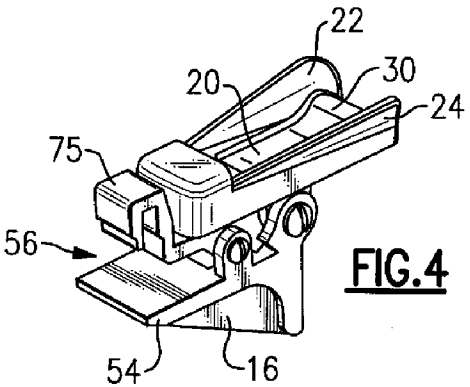
FIG. 4 is a front perspective view thereof.
Figure 6:
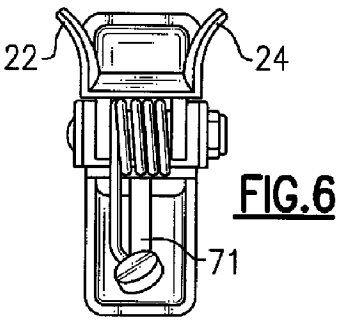
FIG. 6 is a rear elevation view thereof.
Figure 7:
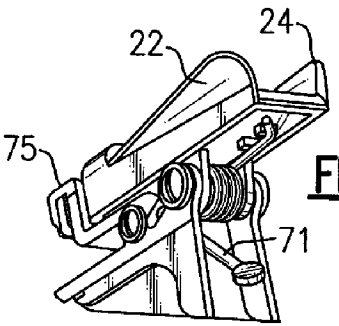
FIG. 7 is a rear perspective view thereof.
Figure 3:
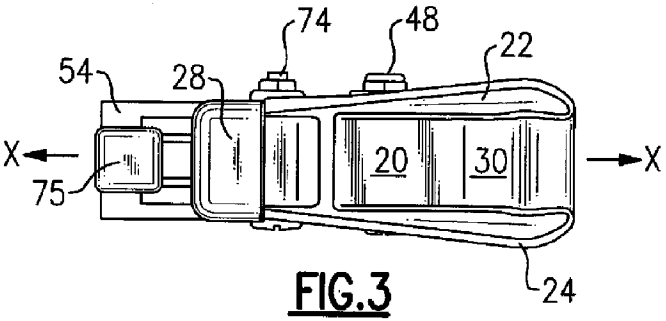
FIG. 3 is top plan view thereof.
Figure 2:
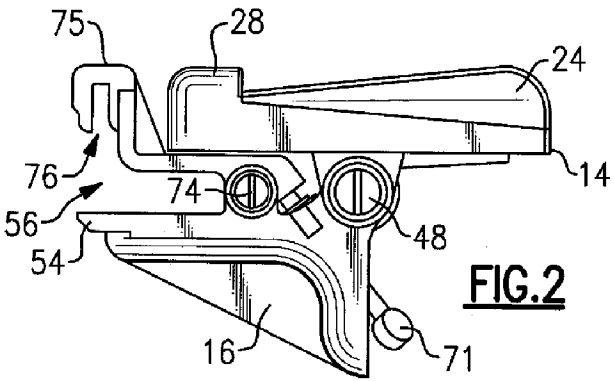
FIG. 2 is a side elevation view thereof.
Figure 8:
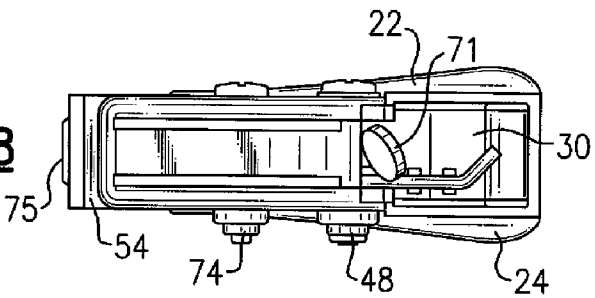
FIG. 8 is a bottom plan view thereof.
Figure 5:
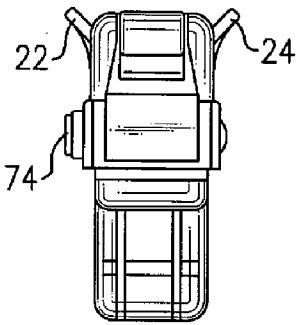
FIG. 5 is front elevation view thereof.

Referring now to the drawing figures in which like reference numerals refer to like parts throughout, there is seen in FIG. 1 a drum accessory, designated generally by reference numeral 10, adapted to be attached to a drum (not shown) and impart a flipping trajectory to a drumstick 12. Drum accessory 10 generally comprises a body member 14 pivotally interconnected to a base member 16. An intermediate clamping member 18 is connected to base member 16 in a cooperative manner to provide a secure mechanism for connecting accessory 10 to a drum rim.

Body member 14 is elongated along axis X—X and includes a groove 20 formed longitudinally along its upper surface and defined by opposing sidewalls 22, 24. A rearwardly facing cavity 26 is defined at the leading edge of body member 14 by a rear wall 27, upper wall 28, and the forward-most portions of opposing side walls 22, 24. A resilient pad 30 composed of rubber, foam, or an equivalent material is positioned within groove 20 and provides a friction surface on which drum stick 12 can be placed. The trailing edge of body member 14 includes a ramped portion 32 that terminates in a downwardly tapered surface 33. Ramped surface 32 causes a drum stick 12 placed within groove 20 to be higher at its trailing end than at its tip which is adapted to be positioned within cavity 26. Having drum stick 12 extending at a downward angle relative to body member 14 promotes the forward flipping trajectory that is imparted thereto upon depression and release of body member 14, as will be described in greater detail hereinafter.

Body member 14 further includes a pair of yokes 34, 36 extending downwardly from the bottom surface thereof and that have axially aligned holes formed therethrough. Base member 16 includes a pair of yokes 38, 40 having axially aligned openings formed therethrough and that extend upwardly from the trailing edge thereof. A conventional torsion spring 42 having a first end 44 connected to base member 16 and a second end 45 connected to body member 14, thereby interconnecting body member 14 to base member 16, further includes a coil portion 46 positioned between its first and second ends. A pivot pin 48 passes through the openings formed through yokes 34, 36, 38, and 40, and the opening defined by coil portion 46, thereby fixing the boundaries of the pivotally movable relationship between body member 14 and base member 16 created by spring 42.

Base member 16 further comprises a pair of ears 50, 52 positioned at an intermediate position along the length thereof and that include axially aligned openings formed therethrough. In addition, base member 16 includes an upwardly facing planar surface 54 extending from ears 50, 52, to its leading edge. A groove 56 is defined between surface 54 and a portion of intermediate clamping member 18. Groove 56 may be used to engage a portion of a drum's rim in order to mount accessory 10 to the drum. Finally, base member 16 includes an opening formed diagonally therethrough relative to the plane in which surface 54 extends and at an intermediate position therealong.

A connector 60 includes a central counter-sunk opening 62 that is positioned in co-axial relation to opening 60 and includes a pair of arms 64, 66 extending along an axis transverse to axis X—X from either side of opening 62. Arms 64, 66, engage notches 68, 70, respectively, that are formed between yokes 38, 40 and ears 50, 52, respectively, and a bolt 71 passes through openings 60 and 62 and is secured with a nut 73 that sits within the counter-sunk opening of connector 60 when fully tightened.

Intermediate clamping member 18 extends along a longitudinal axis essentially parallel to axis X—X, and includes an opening 72 that extends transversely thereacross at its rearward end. Opening 72 is axially aligned with the openings formed through ears 50, 52 such that a bolt 74 can pass therethrough and interconnect base member 16 to intermediate clamping member 18. The leading end 75 of intermediate clamping member includes a downwardly directed groove 76 adapted to engage the rim of a drum. The bottom surface of intermediate claiming member is adapted to lie in contacting relation to upwardly facing planar surface 54.

In operation, accessory 10 is securely mounted to a drum by use of clamping member 18 and/or base member 16, depending upon the orientation of the drum to which it is being connected. Drum stick 12 is then positioned along groove 20 with its tip positioned within cavity 26. A user may then press downwardly upon drum stick 12, thereby causing body member 14 to pivot downwardly relative to base member 16 and place torsion spring 42 in tension. The user may then release drum stick 12, causing spring 42 to recoil and pivot body member 14 upwardly towards its neutral position. When body member 14 stops moving, its momentum causes drum stick 12 to continue moving in an upward direction. Due to the tip of drum stick 12 being housed within cavity 26, its upward motion causes the tip to contact the upper wall defining cavity 26 and impart a forward flipping motion to stick 12. The amount of flip imparted to stick 12 is dependant in part on the amount of deflection the user imparts to body member 14, and the orientation of accessory 10 on the drum.

It will be readily apparent to those skilled in the art that modifications may be made to the present invention without departing from its full spirit and scope which are defined by the appended claims.

What is claimed is:

1. A device for holding and releasing a drum stick relative to a drum, said device comprising:

a. a body member extending along a longitudinal axis, and including a groove formed along said longitudinal axis that terminates in a stick receiving cavity portion;

b. a base member interconnected to said body member and including a mechanism for interconnecting the device to a drum;

c. said body member being pivotally movable relative to said base member; and d. a spring connected between said body member and said base member;

e. said groove further comprising a resilient pad.

2. The device according to claim 1, further comprising a spring connected between said body member and said base member.

3. The device according to claim 1, further comprising a clamp mechanism positioned between said base member and said body member.

4. The device according to claim 3, wherein said clamp mechanism includes a leading edge with a groove formed therein that is adapted to engage the rim of a drum.

5. The device of claim 1, further comprising a pair of opposing sidewalls formed on opposite sides of said groove.

6. The device according to claim 1, wherein said stick receiving cavity is defined by an end wall, opposing sidewalls, and an upper wall.

7. The device according to claim 1, wherein said groove includes a trailing end and a leading end, said stick receiving cavity is formed at the trailing end and a ramped portion is formed at said leading end.

8. The device according to claim 1, further comprising means for imparting a flipping motion to the drum stick.

9. A device for holding and releasing a drum stick relative to a drum, said device comprising:

a. a body member extending along a longitudinal axis, and including a groove formed along said longitudinal axis that terminates in a stick receiving cavity portion;

b. a base member interconnected to said body member and including a mechanism for interconnecting the device to a drum;

c. said body member being pivotally movable relative to said base member; and d. a clamp mechanism positioned between said base member and said body member.

e. said groove further comprising a resilient pad;

f. a spring connected between said body member and said base member.

10. A device for holding and releasing a drum stick relative to a drum, said device comprising:

a. a body member extending along a longitudinal axis, and including a groove formed along said longitudinal axis that terminates in a stick receiving cavity portion, wherein a resilient pad is positioned within said groove;

b. a base member interconnected to said body member and including a mechanism for interconnecting the device to a drum; and c. said body member being pivotally movable relative to said base member.

d. said groove further comprising a resilient pad;

e. a spring connected between said body member and said base member.

11. The device according to claim 10, wherein said clamp mechanism includes a leading edge with a groove formed therein that is adapted to engage the rim of a drum.

12. The device of claim 10, further comprising a pair of opposing sidewalls formed on opposite sides of said groove.

13. A device for holding and releasing a drum stick relative to a drum, said device comprising:

a. a body member extending along a longitudinal axis, and including a groove formed along said longitudinal axis that terminates in a stick receiving cavity portion, wherein said groove includes a trailing end and a leading end, said stick receiving cavity is formed at the trailing end and a ramped portion is formed at said leading end;

b. a base member interconnected to said body member and including a mechanism for interconnecting the device to a drum; and c. said body member being pivotally movable relative to said base member;

d. said groove further comprising a resilient pad;

e. a spring connected between said body member and said base member.

14. The device according to claim 13, further comprising means for imparting a flipping motion to the drum stick.

15. The device according to claim 13, wherein said stick receiving cavity is defined by an end wall, opposing sidewalls, and an upper wall.

16. A device for holding and releasing a drum stick relative to a drum, said device comprising:

a. a body member extending along a longitudinal axis, and including a groove formed along said longitudinal axis that terminates in a stick receiving cavity portion;

b. a base member interconnected to said body member and including a mechanism for interconnecting the device to a drum;

c. said body member being pivotally movable relative to said base member; and d. means for imparting a flipping motion to the drum stick;

e. said groove further comprising a resilient pad;

f. a spring connected between said body member and said base member.

17. The device according to claim 16, wherein said stick receiving cavity is defined by an end wall, opposing sidewalls, and an upper wall.

* * * * *